US006005173A

United States Patent [19]

Mitchell

[11] Patent Number: 6,005,173

[45] Date of Patent: Dec. 21, 1999

[54] STRINGED MUSICAL INSTRUMENT

[76] Inventor: Peter Alexander Mitchell, 266 Pelton Ave., Staten Island, N.Y. 10310

[21] Appl. No.: 08/918,802

[22] Filed: Aug. 26, 1997

[51] Int. Cl.[6] ..... G10D 3/00

[52] U.S. Cl. ..... 84/291

[58] Field of Search ..... 84/291, 293

[56] References Cited

U.S. PATENT DOCUMENTS

| | | | |
|---|---|---|---|
| 375,224 | 12/1887 | Talbott . | |
| 1,183,369 | 5/1916 | Gardie . | |
| 1,304,914 | 5/1919 | Smith . | |
| 4,242,938 | 1/1981 | Zalinge | 84/291 X |
| 4,646,613 | 3/1987 | Banchetti . | |
| 5,537,906 | 7/1996 | Steinberger | 84/291 |
| 5,576,082 | 11/1996 | Jarrett . | |

*Primary Examiner*—Jeffrey Donels
*Attorney, Agent, or Firm*—Lieberman & Nowak, LLP

[57] ABSTRACT

A hollow, tubular wooden musical instrument comprises a body portion of lightweight, tubular cross-section having a first and second opposite ends and at least one wooden laminate layer defining a fingerboard surface along a length of the body portion; a tuning device capable of tensioning a plurality of strings mounted lengthwise along the fingerboard surface, the body portion being capable of withstanding string tensions of up to 1200 psi perpendicular to the body portion, and defining structure for emanating sounds produced by vibrating the strings. The hollow musical instrument has a conic-section cross section, e.g., circular or elliptical, or a compound conic-section cross-section, e.g., lute shape, and may be of uniform diameter, conical, or tapered diameter formats. It may be played as an acoustic or electric instrument. The hollow, tubular instrument can additionally be of modular design having predefined sections to facilitate changes of sounds or fingerboard surfaces. Whether of unitary or modular design, the instrument can be fitted in a sound chamber to provide additional resonance of tones generated by strings, or may be retrofitted in existing sound chamber devices.

37 Claims, 7 Drawing Sheets

STRINGED MUSICAL INSTRUMENT

RELATED DISCLOSURE

The subject matter of the present invention was submitted on Apr. 28, 1997 to the United States Patent and Trademark Office and assigned as Disclosure Document #420276.

FIELD OF THE INVENTION

The present invention relates generally to musical instruments, and particularly, to a hollow, lightweight, stringed musical instrument capable of being played as a guitar, violin, bass, and the like, and that can be played in amplified or acoustic formats.

BACKGROUND OF THE INVENTION

All over the world and throughout the ages there has appeared many wooden stringed musical instruments, predominantly that are played by picking of the strings, e.g., with fingers or picks, or by bowing the strings, e.g., with a bow. Ethnic types of wooden stringed instruments that may be played by a bow include Valihas, Tambura, and zithers. These instrument traditionally are tubular shaped instruments having strings tensioned across the length of the tube and having a bridge mechanism lying transverse to the length of the strings.

The Tambura, in particular is a "drone lute", and is not designed for melodic playing. It contains a bridge that is moveable for adjusting the pitch and in essence lays down an accompanying chord as a backdrop for some other instrument. This instrument may be an idiochord, having a single string or, a heterochord instrument with multiple strings. Zither instruments are also droning instruments, and as such, produce one fundamental tone per string, with its associate overtones, at a time.

The Valihas is a heterochord instrument with multiple strings, and is more closely related to the harp with each string set to a specific pitch before they are played.

A common instrument found in India is the sitar, which may include a hollow neck that forms a gourd shaped resonant body and is not designed as a drone. Played strings run over arched metal and movable frets and sympathetic strings run under the frets in the troughed neck to lateral tuning pegs.

The more commonly known and appreciated stringed instruments include the guitar and related instruments, e.g., bass guitar, banjo, dobro, etc., and the violin, and related family of instruments, e.g., cello, viola, double bass, etc.

As shown in FIG. 1, the conventional guitar 40 is characterized by a body 45, having incurved sides 45*a* and 45*b*, a solid neck portion 55 extending from the body. Six strings 44 are fastened by tailpiece 47 at one end of the body 45 that are tensioned to pass over a bridge 46 mounted on the body and additionally pass over a nut 43 mounted near the end of the neck 55 and are wound around tuning pegs 42 situated at the end of the neck. For most of their length, the strings pass over a fingerboard 48 with the vibrating length of each string being defined by the bridge 46, and the nut 43. Frets 49 are provided that are pressed by fingers for changing the length of the vibrating string. A large circular hole 51 is provided for providing emanating sounds produced by the vibrating strings and resonating through the hollow body structure.

A hollow box shown in broken lines 52 forms the body of the guitar and functions to make the sound from the vibrating strings audible. The hollow box 52 is actually part of a resonant system consisting of a strings stretched across a bridge, and set into vibration at its resonance frequency which, in turn, exerts vibrating forces on the body of the instrument through the bridge. Particularly, the traditional bridge 46 (FIG. 1) has a foot print of 0.25 sq. in. to 6.0 sq. in. at the point where the bridge rests on the top plate of the sound chamber. The body 45 of the instrument serves two functions such as supporting the strings so that they can vibrate properly, and to make the sounds from the vibrating strings audible. As vibrating strings themselves disturb very little air and hence practically radiate no sound, the important job of the guitar body is to transmit these strings vibrations to the air in such a way as to give them loudness and tone.

The quality of the sound the guitar radiates will depend not only on the harmonic structure of the vibration of the string, but also on the way in which these harmonics are transmitted through the bridge to the body, and hence to the air through sound hole 51.

As shown in the side view of the hollow guitar body 45 FIG. 2, the strings 44 are when tensioned over the bridge 46 in the direction indicated by arrow B and arrow F. String tensions on guitars start at about 18 psi for the thinnest string on an acoustic guitar up to about 40 psi on the low "E" string of an electric guitar, heavy gauge). For an electric bass, string tensions may start at about 35 psi, for the thin string and exceed over about 50 lbs. for the lowest (heaviest gauge) string. Strings on upright acoustic basses may be tensioned starting at 60 psi and can exceed over 70 psi on the lowest string. The resulting tension creates a resultant force that is exerted downward as indicated by the direction of arrow A. This force is transmitted downward to the top plate of the body 45 with the transmitted downward force being proportionate to the tensile force of the string.

In view of the tensile forces exerted by the strings on such guitar instruments, especially in consideration of a hollow neck structure instead of the predominant solid neck construction as used in more commonly known and appreciated stringed instruments, it readily is understood that a minimum material wall and body strength must be provided. Thus, for example, a bass guitar, e.g., cannot be simply manufactured by tensioning a bass guitar string on a long piece of hollow bamboo, as the bamboo just can't hold the tension. Moreover, it is not a simple matter of just getting a larger piece of wood and hollowing it out, because, in order to withstand the string tension forces exhibited, the body walls would have to be thick or reinforced with strengthening materials, e.g., plastics or wood, making the instrument too heavy, bulky, and with very little body resonance.

It would thus be highly desirable to provide a wooden stringed musical instrument that is lightweight and easy to play, and can be manufactured at relatively low cost.

Additionally, it would be highly desirable to provide a wooden stringed musical instrument that is lightweight, hollow, and of cylindrical or conical (tapered) construction, and that can be circular and/or elliptical in cross-section and capable of accommodating tension created by thick gauge guitar strings, e.g., bass guitar strings.

Moreover, it would thus be highly desirable to provide a wooden musical stringed instrument that is lightweight and may be modular or unitary in design, and, is capable of being played in acoustic or electric formats, with or without additional sound chamber structure.

SUMMARY OF THE INVENTION

The instant invention is a lightweight, musical instrument comprising a hollow, body portion made of one or more layers of wood and having opposite ends and at least one wooden layer defining a fingerboard surface along a length of the body portion. Cooperative tensioning devices are provided at each of the opposite ends for tensioning a plurality of strings lengthwise along the fingerboard surface. Advantageously, the body portion is capable of withstanding tensile forces created by the strings applied to said wooden layers at the opposite ends and additionally defines structure for emanating sounds produced by vibrating the strings. Even though it is preferred that a wood veneer be the sole construction material, use of graphite or other composite material may be used in accordance with the principles described herein. The hollow, tubular musical instrument can be cylindrical with an elliptical or circular (conic section) cross sectional profile, and may be of uniform cross-sectional diameter or, may be conical or tapered with an elliptical, circular or lute-shape cross-sectional profile. The hollow, tubular instrument may be dimensioned to accommodate any type of string to function as a guitar, bass guitar, and/or other stringed instruments, e.g., banjo, dobro, violin, and related family of instruments, e.g., cello, viola, double bass, etc. It may be played in acoustic or electric formats with or without an additional sound chamber and may be modular in design to facilitate change of sound qualities or fingerboard surfaces.

The various features of novelty which characterize the invention are pointed out with particularity in the claims annexed to and forming a part of the disclosure. For a better understanding of the invention, its operating advantages, and specific objects attained by its use, reference should be had to the drawings and descriptive matter in which there are illustrated and described preferred embodiments of the invention.

BRIEF DESCRIPTION OF DRAWINGS

FIG. 11(*b*) illustrates the string tree mounted by bolts about a portion of the circumference of the tubular stringed instrument 100.

FIG. 17(*b*) illustrates transference of string vibrations from the hollow, tubular stringed musical instrument into the sound chamber.

DETAILED DESCRIPTION OF THE INVENTION

Figure 3:
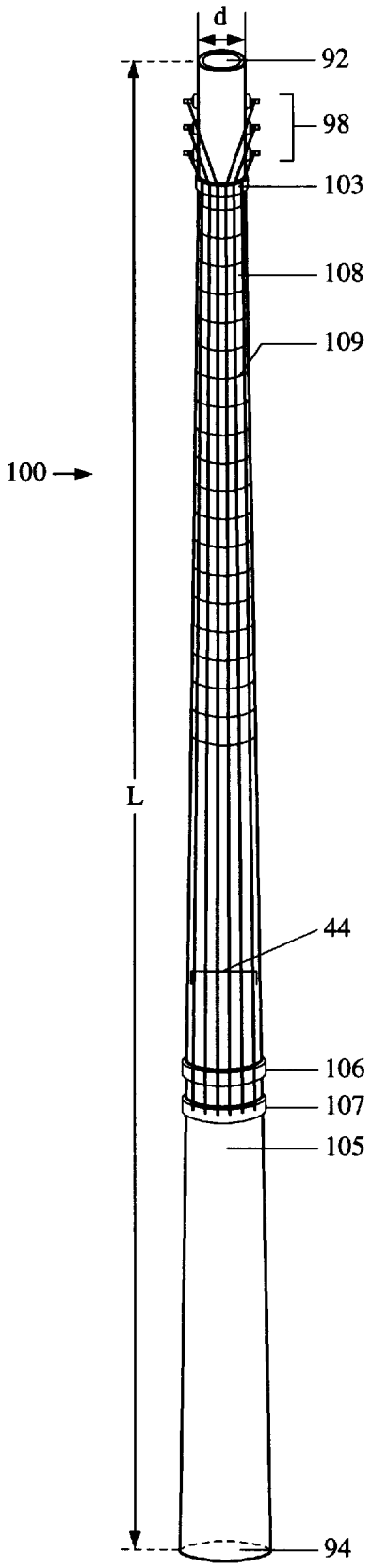
FIG. 3 is a front view of the hollow, conical/elliptical profile stringed musical instrument 100 of the invention.

FIG. 3 is a front view of the hollow, conical/elliptical-shaped wooden musical instrument 100 of the invention. When referred to herein, tubed or tubular shall mean hollow cylindrical, hollow conical, or hollow tapered—be it of conic-section cross-sectional configuration, e.g., circular or elliptical, or, compound conic-cross-sectional configuration, e.g., lute-shaped.

As shown in FIG. 3, the hollow, tubed instrument 100 comprises a combined neck and body portions formed of a hollow, tubular body structure 105 made from wood. Generally, mounted at a first end of the neck and body structure 105 are tuning machines (heads) 98 for winding one end of a plurality of, e.g., steel, gut or nylon, strings 44 across the length of the body structure 105 with the strings being fastened at their opposite end of the body structure 105 by a mounted tail piece or fastening devices 107. In the preferred embodiment, the tuning machines are mounted on the body exterior with winding posts 97 protruding away from the body. The strings are positioned across nut 103 and bridge 106 devices that are mounted on the body structure for providing the desired string arch and spacing above the surface of the tubular body. Tensioning of the strings to a desired fundamental frequency is provided by winding of the tuning machines 98.

The majority of the length of strings 44 are tensioned over a surface of the neck body structure defining a fingerboard, 108 with the vibrating length of the string defined between the nut and bridge devices. Optionally, the fingerboard surface may contain frets 109, that function to change the lengths of the vibrating strings when pressed.

In further view of FIG. 3, the hollow, tubular-shaped wooden musical instrument 100 is provided with two ends 92 and 94, with each end being open for emanating sounds produced by vibrating strings. To alter or emphasize certain string tones, one or both of these ends may be closed, with sound holes (not shown) being provided throughout the body structure. As will be explained, the instrument 100 may be played in both acoustic and electric (amplified) formats.

The hollow, tubular structure 105 is preferably made of bonded alternating layers of wood with particular types of wood veneer, e.g., Ash, Ebony, Alder, Mahogany, Red Oak, Maple, Rosewood, and like hardwoods, and weighs anywhere from 0.50 to 4.0 lbs. depending upon its length L, diameter d, and cross-sectional thickness. In further embodiments, the hollow, tubular wooden musical instrument 100 may be of unitary or modular design, and, can be circular or elliptical in cross-section, in either uniform (constant diameter as measured from side to side), or tapered (smaller head diameter to increasingly larger tail diameter as measured from side to side) formats. Typically, the length L of the hollow stringed instrument 100 will range anywhere from 1.5–2.5 feet when designed as a violin, from 2.0 to 4.0 feet when designed as a guitar, and 3.0 to 8.0 feet and when designed as a string bass guitar. Regardless of the design format, (unitary or modular), the hollow, tubular musical instrument 100 structure comprises wood veneer layers ranging anywhere from between 1/16" (inches) and ½" (inches) thick and, when circular in cross-section, may be anywhere from 1¼" (inches) to 6" (inches) in diameter.

In accordance with the preferred embodiment of the invention, the hollow, tubular body 105 is formed by a process substantially disclosed in U.S. Pat. No. 5,576,082, assigned Hollowood, Inc. (Clinton Township, Mich.), the contents and disclosure of which is incorporated by reference herein. Specifically, the hollow, tubed wooden body comprises a tube made from up to four wood veneer layers bonded together preferably by thermosetting adhesive. The hollow, wooden tube body can be made in varying lengths, varying wall thicknesses, and diameters with types of wood veneer layers being, e.g., Red Oak, Maple, Rosewood, and the like. Preferably, any combinations of wood veneer layers may be used depending upon the tonal and textural qualities desired of the stringed instrument. As described in U.S. Pat. No. 5,576,082, the tube body is preferably characterized as comprising between two and four wood veneer layers with each layer made from a flat sheet of wood veneer manufactured such that the grain in one layer, for example, extends longitudinally, while the grain in an adjacent layer extends circumferentially of the tube so that the grain in adjacent layers extend transversely of each other. Each of the joints for layers having a longitudinally extending grain direction are edge butt joints and all joints extending transversely to the wood grain being interlocking finger joints and with adjoining tubular layers being bonded to each other. Such a design creates a strong tube capable of withstanding up to 3000 lbs. of compressive forces and surface supportive loads of up to 1200 psi. Even though it is preferred that wood veneers be the sole construction material, use of graphite or other composite material may be used.

It is easy to comprehend that the structural integrity of the wood tubes is such that when formed as a stringed musical instrument, e.g., a guitar or bass, it may easily withstand the tensile forces acting on the surface as created, e.g., heavy-gauge, double bass strings tensioned along its length.

Figure 4:
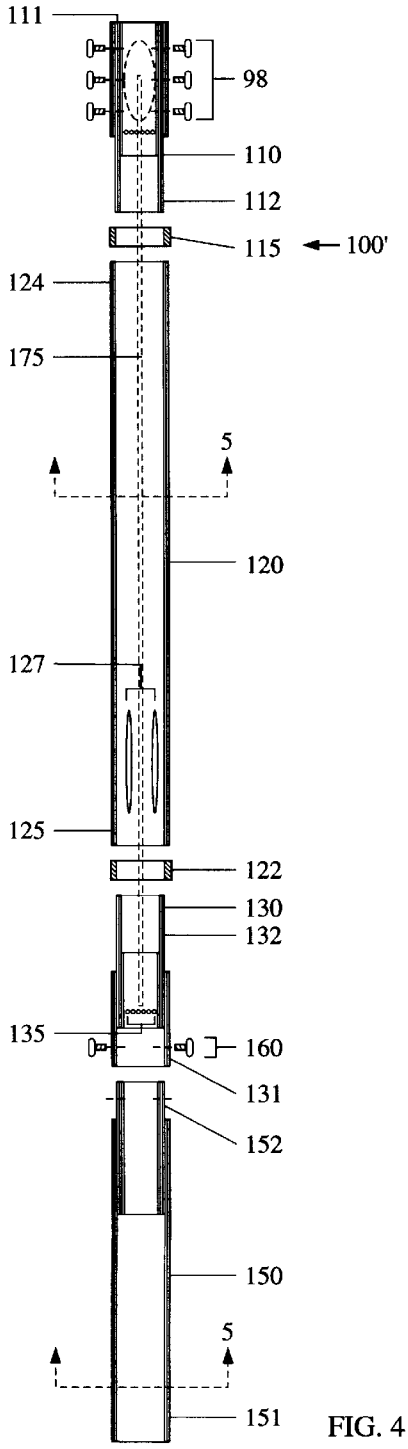
FIG. 4 is an exploded view of the hollow, tubular stringed musical instrument of modular design.

FIG. 4 illustrates a detailed, exploded view of the tubular musical instrument 100', in this case a six-string guitar or bass, in a modular design. As shown in FIG. 4, the musical instrument 100' includes a hollow head piece section 110, a hollow neck/body portion 120 of constant and diameter, and a hollow tail piece section 130. Optionally, when it is desired to extend the length of the instrument, e.g., to play a double bass, a base or extension 150 may be added to the tail piece portion.

As shown in FIG. 4, the head piece 110 is for mounting a plurality of machine heads 98 corresponding to the number of strings, e.g., six (6) as shown. The head piece comprises a first section 111 of a larger diameter for mounting the machine heads and a thinner diameter section 112 of sufficient length and width so that it is attached, preferably by friction fit, to a first end 124 of the hollow neck/body portion 120. It is understood that the larger diameter portion of the head piece 110 is the same diameter as the hollow neck/body portion 120. The manufacture of the head piece 110 having two different diameters is achievable by modifying the process described in U.S. Pat. No. 5,576,082.

Figure 11A:
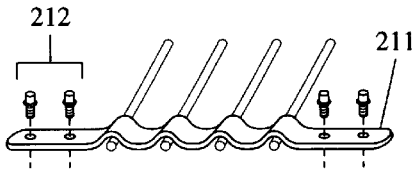
FIG. 11(*a*) illustrates a string tree 211 provided to create downward angle of the strings from the nut to the machine heads.
Figure 11B:
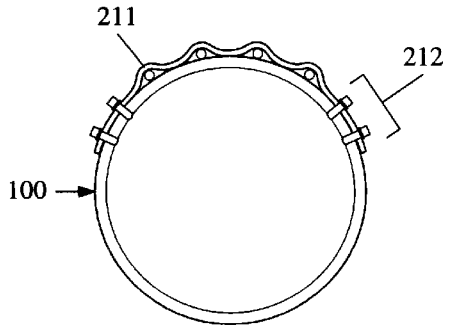

A nut 115 is shown that is attached, preferably by friction fit on the smaller diameter portion 112 of the head piece 110 proximate the machine heads 98, to align the strings along the playing surface of the instrument. The smaller portion 112 of the head piece is designed such that it will fit within the larger diameter neck/body portion 120. As shown in FIG. 11(*a*), a string tree 211 is provided to create the desired downward angle of the strings 44 as they pass from the nut 115 to the machine heads 98 and, additionally, to align or space apart the strings in the desired manner. FIG. 11(*b*) shows the string tree 211 mounted by bolts 212 about a portion of the circumference of the tubular stringed instrument 100.

Referring back to FIG. 6, the neck/body portion 120" provides the surface 123 upon which the strings are played, and which can include a fretted or unfretted surface. The neck/body portion may contain one or more sound holes 127 for emanating sound from the hollow neck/body member 120".

Referring back to FIG. 4, the tail piece section 130 contains a plurality of peg-holes 135 corresponding to the number of strings, e.g., six (6), that may be simply drilled for tensioning the other end of the strings (not shown) across the full length of the neck/body. The tail piece comprises a first section 131 of a larger diameter for mounting the locking screws 160 and a thinner diameter section 132 of sufficient length and width so that it is attached, preferably by friction fit, to the opposite end 125 of hollow neck/body portion 120. It is understood that the larger diameter portion of the tail piece 130 is the same diameter as the neck/body portion. The manufacture of the tail piece 130 having two different diameters is achievable by modifying the number of layers in the smaller diameter section during assembly as described in U.S. Pat. No. 5,576,082.

Figure 12:
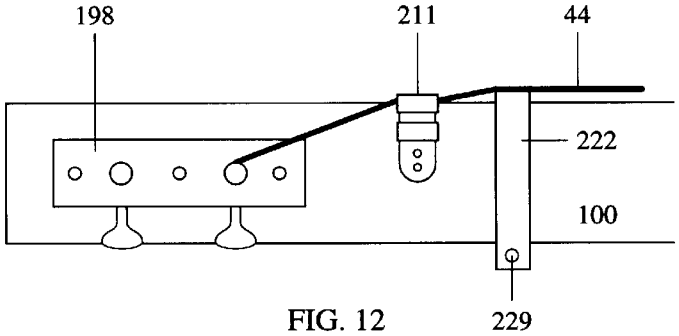
FIG. 12 illustrates a side view of the instrument showing nut device clamped around the instrument 100 by means of a screw.
Figure 13:
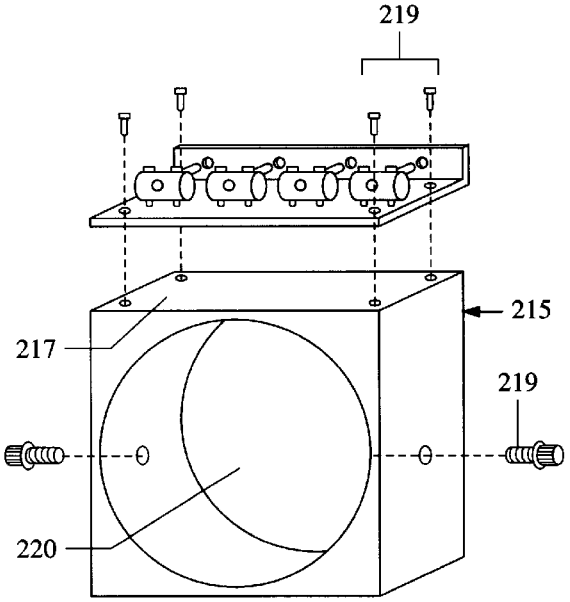
FIG. 13 illustrates a bridge platform collar 215 for mounting a bridge between the tail piece and neck/body section.
Figure 14:
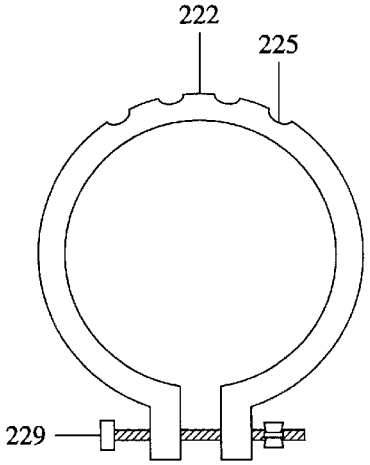
FIG. 14 illustrates the nut and bridge portions formed as a flat ring for clamping or bolting onto the tubular instrument.

In the preferred embodiment, a bridge portion 122 of even diameter with the neck/body is provided to be fit between the tail piece 130 and neck/body section 120 for tensioning each of the strings and raising them to a desired height, particularly to facilitate playing of the instrument with fingers, (finger)picks, bows, etc. As shown in FIG. 13, a bridge platform collar 215 is provided for mounting between the tail piece 130 and neck/body section 120, and preferably has at least one flat outside surface 217 for accommodating mounting of a standard bridge, e.g., P-Bass style bridge manufactured by Fender. The collar 215 contains a hollowed interior 220 in the shape of the instrument's tubular profile such that it can be bolted to the tubed instrument neck/body section by bolts 219. Alternatively, as shown in FIG. 14, either or both of the nut 115 and bridge 122 portions can be formed as a flat ring 222, e.g. made of brass, having an inside ring surface designed to lay flush against the body of the tubed instrument. The ring 222 can be ⅛" (inches) to ¼" inches wide and, e.g., ranging between 3/16" inches and ½" inches thick. Saddle portions 225 are provided on the surface of the ring to seat the strings. As shown in FIGS. 12 and 14, the ring 222 is clamped tightly around the instrument 100 by means of a nut or screw 229 which passes through holes provided at each end of the ring.

Figure 5A:
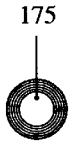
FIGS. 5(*a*)–(*c*) illustrate cross-sectional views taken along line A—A of FIG. 4, with FIG. 5(*a*) showing circular cross section, FIG. 5(*b*) showing elliptical cross section, and 5(*c*) showing a compound conic-section mix between circular and elliptical cross section, i.e., a lute shape profile.
Figure 5B:
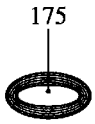
Figure 5C:
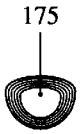

The neck/body portion 120, as shown in FIG. 4 and described above, is of one-piece tubular design and substantially circular in cross section, as shown in FIG. 5(*a*). Likewise, the head piece 110, tail piece 130 and base extension 150 sections are all circular in cross section.

The hollow base/extension section 150 also contains a larger diameter section 151 and a smaller diameter section 152. The smaller diameter section 152 is fitted snugly within the larger diameter portion of the neck/body and may be more permanently attached by means of an extension lock 160. Increasing the length of the instrument 100' by way of base/extension portion 150, provides a more comfortable and convenient fit for a musician desiring to play the instrument "standing-up", e.g., as in an upright bass. Thus, the instrument becomes fully functional as a viola or double bass practice instrument.

As shown in FIGS. 5(*b*) and 5(*c*), upon reading of U.S. Pat. No. 5,576,082, the mandrel element 64 upon which the tubular form is attained in the described process, may be designed accordingly to form hollow modular head piece 110, neck/body 120, tail piece 130 and base extension 150 components having a conic-section cross-sectional configuration, e.g., elliptical, such as shown in FIG. 5(*b*), or compound conic-section cross-sectional configuration, e.g., lute-shaped, such as shown in FIG. 5(*c*). Thus, in accordance with the principles of the invention described herein, other tubular-shaped musical instruments, e.g., horns or woodwinds, may be designed with such hollow tubes.

Figure 15A:
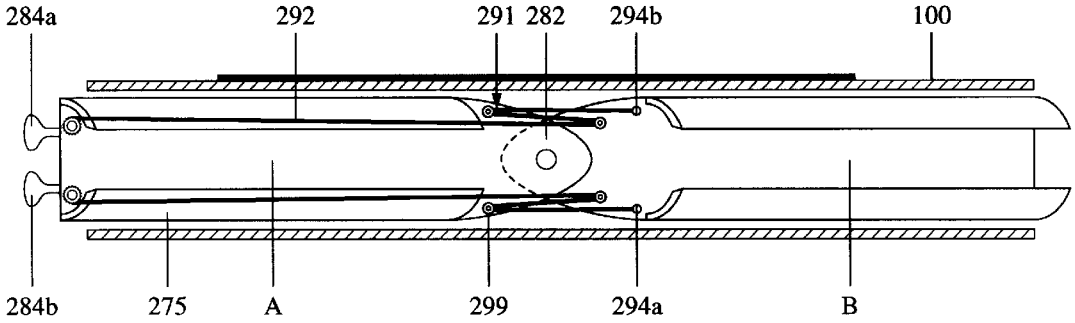
FIGS. 15(*a*) and 15(*b*) illustrate a detailed view of truss rod of I-beam construction.
Figure 15B:
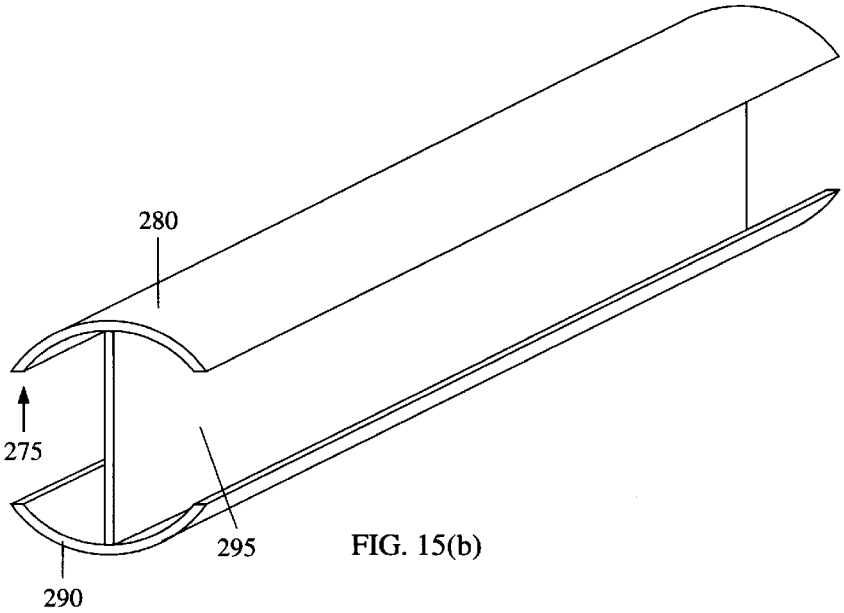

Additionally, as shown in FIG. 4, the instrument 100' may be pre-stressed to reinforce or relieve the shape of the fingerboard area of the neck/body portion, for example, by providing a truss rod 175 extending from the head-piece to the tail-piece through the hollow tube neck/body section. Tensioning of the truss rod 175 will enable the fingerboard surface to slightly bend in accordance with the desired comfort of the musician. A preferred embodiment of the truss rod 175 is shown in FIGS. 15(*a*) and 15(*b*) which illustrate an I-beam construction 275 of wood veneer ply, graphite and/or other composite material of about ⅛" thick consisting of a top cap portion 280, a bottom cap 290, and a center member 295, with the top cap 280 and bottom cap 290 matching the inside profile of the tube. Preferably, the center member 295 is ¼" smaller than the diameter of the tube. As shown in FIG. 15(*a*), the I-beam 275 is of two sections indicated as section "A" and "B" and connected by a pivot joint 282 which is, e.g., a bolt that connects the two I-beam segments A,B at the midpoint of the center member. Section A of the I-beam extends from a point just past the machine heads to a point being a distance equal to ⅙ the scale length L of the instrument (FIG. 3(*a*)). For example, when the length L of the instrument is 42" (inches), this point will be about 7" (inches from the nut). Section B, on the other hand, will extend from the pivot joint 282 to the tail piece section 130 (FIG. 4). As shown in FIG. 15(*a*), a pair of gears 284*a*, 284*b* are attached at the top end of the I-beam, just past the machine heads and next to the center members midpoint. A suitable cable tensioning system 291 consisting of cable 292 extending from the gears 284*a,b* and anchored by suitable means 294*a,b* to the center member a few inches past the pivot joint at section B of the I-beam 275 is provided. The cable 292 is engaged by a series of small pulleys 299 situated between the Sections A and B and is anchored at one end 294*a* to the center member 295 close to bottom cap 290 and at the other end 294*b* close to top cap 280. By varying the tension of the cables by gears 284*a,b*, the exact adjustment of the relief can be achieved.

Figure 7:
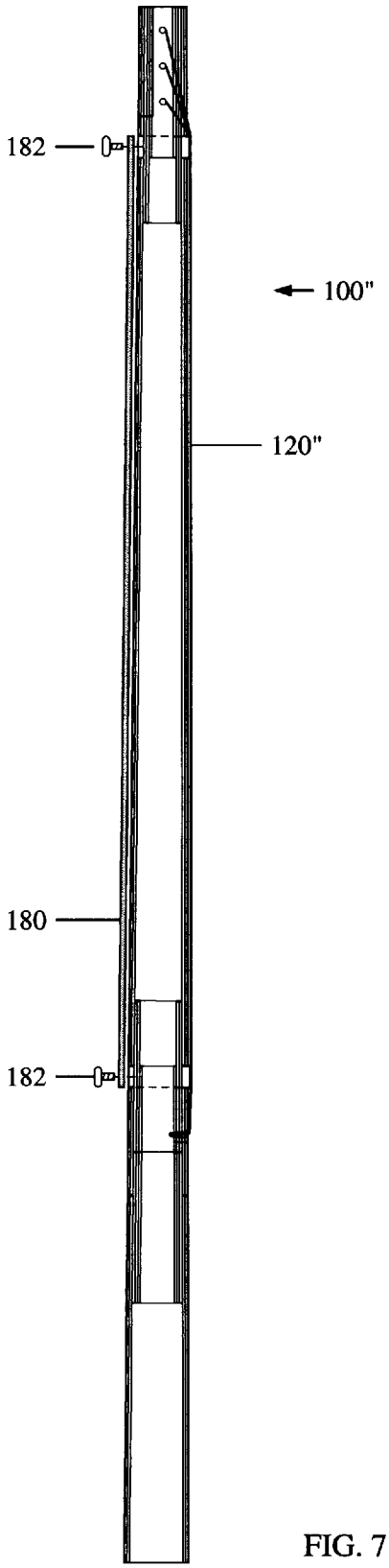
FIG. 7 is a side elevational view of the tapered stringed musical instrument of FIG. 6.

The modular design of the musical instrument 100' is intended to provide versatility at minimal cost. Thus, a musician who has become more proficient at, e.g., a fretted bass, may desire to switch, e.g., to a fretless instrument, which would simply require the replacement of the hollow neck/body section 120 with one of fretless design. Furthermore, a musician desirous of increasing the length of the neck/body portion, may simply replace the neck/body portion 120 with one of longer design. Additionally, one desirous to play an instrument having particular tonal or textural qualities may change the length neck/body portion with a neck/body portion of different types and thicknesses of wood laminate layers. Moreover, if a musician wanting to switch, e.g., from a four string base to a six string guitar, would only have to replace modular head piece 120, nut 115, bridge 122 and tail piece 130 sections. Additionally, when the neck/body section 120 is circular (FIG. 5(*a*)) or elliptical (FIG. 5(*b*)) in cross-section, it can be provided with both fretted and unfretted surfaces on opposite sides. Thus, the musician may simply loosen or disassemble the strings, detach the head- and tail-sections and rotate the hollow neck/body 180° to provide the desired fretless (playing surface). (FIG. 7) The head and tail sections may then be reattached and the strings tensioned so that the instrument may again be played. In such an embodiment, when the opposite-side fretted portion is not being used, a fretboard cover 180 may be provided to protect the fretboard surface and more importantly, to provide as smooth surface for the musician when playing the opposite fretless fingerboard surface such as shown in FIG. 7. It should be understood that the lute shape cross-section, shown in FIG. 5(*c*) can be achieved by cutting out an outer layer of the body portion to accommodate placement of a flat fingerboard surface which will result in a lute shape tubular instrument.

Figure 6:
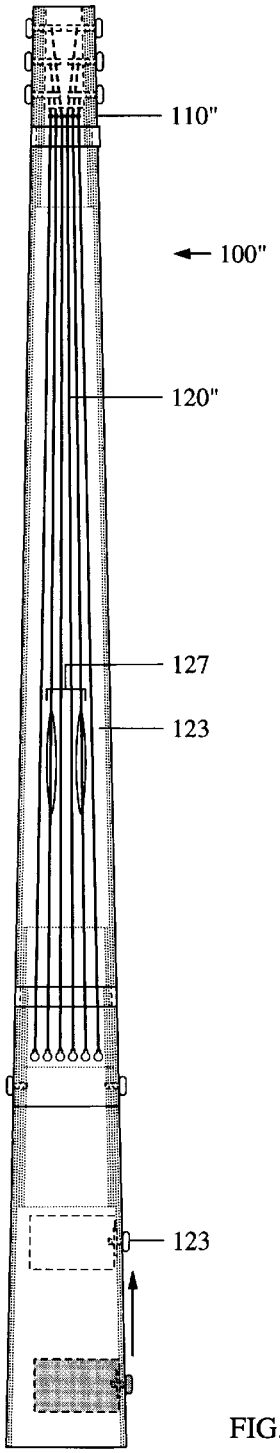
FIG. 6 is a top view of the elliptical stringed musical instrument of tapered design.

FIGS. 6 and 7 illustrate a further embodiment of the hollow musical stringed instrument 100" wherein the hollow neck/body portion 120" surface is tapered outward longitudinally from the head to tail piece. Specifically, one may extend the teachings of U.S. Pat. No. 5,576,082, to formulate the tapered, hollow neck/body portion 120" by first providing a sub-assembly 43 of wood veneer layers cut and arranged in such a manner that, when formed around the mandrel element 64, will provide the tapered shape. As in the modular design of the musical instrument of FIG. 4, the cross-sectional view for the tapered instrument may be circular, elliptical, or lute shaped such as shown in FIGS. 5(*a*), (*b*), (*c*), respectively.

FIG. 7 specifically illustrates a cross-sectional side view of the conical hollow stringed instrument 100" shown in FIG. 6, and particularly, the fretboard cover 180 that may secured over the unplayed fretted surface opposing, e.g., the playing fretless surface. The fretboard cover 180 is made by slicing off a fingerboard area from a second shaft and cutting shallow grooves (not shown) on the concave side of the cover so that it would fit over, and interlock with, the fretted side of the instrument. This cover would then be locked against the frets using two "cover locks" 182 which are screwed into the backs of the nut and bridge portions respectively, thus providing a smooth surface in which a musician may slide his/her thumb while playing the instrument in fretless form.

Figure 1:
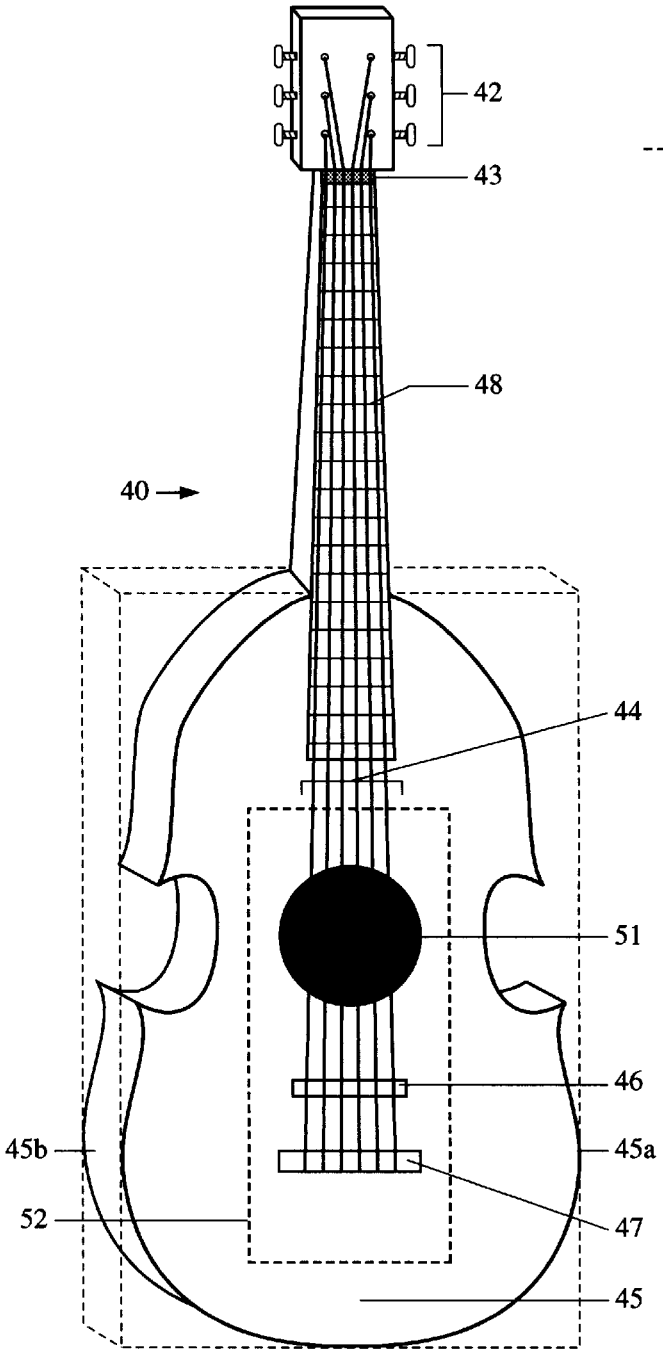
Prior Art FIG. 1
FIG. 1 is a prior art diagram of a conventional acoustic guitar.
Figure 2:
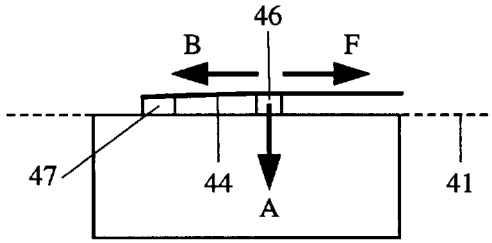
Prior Art FIG. 2
FIG. 2 illustrates string tensile forces acting upon the bridge mounted on the body of the conventional guitar.
Figure 17A:
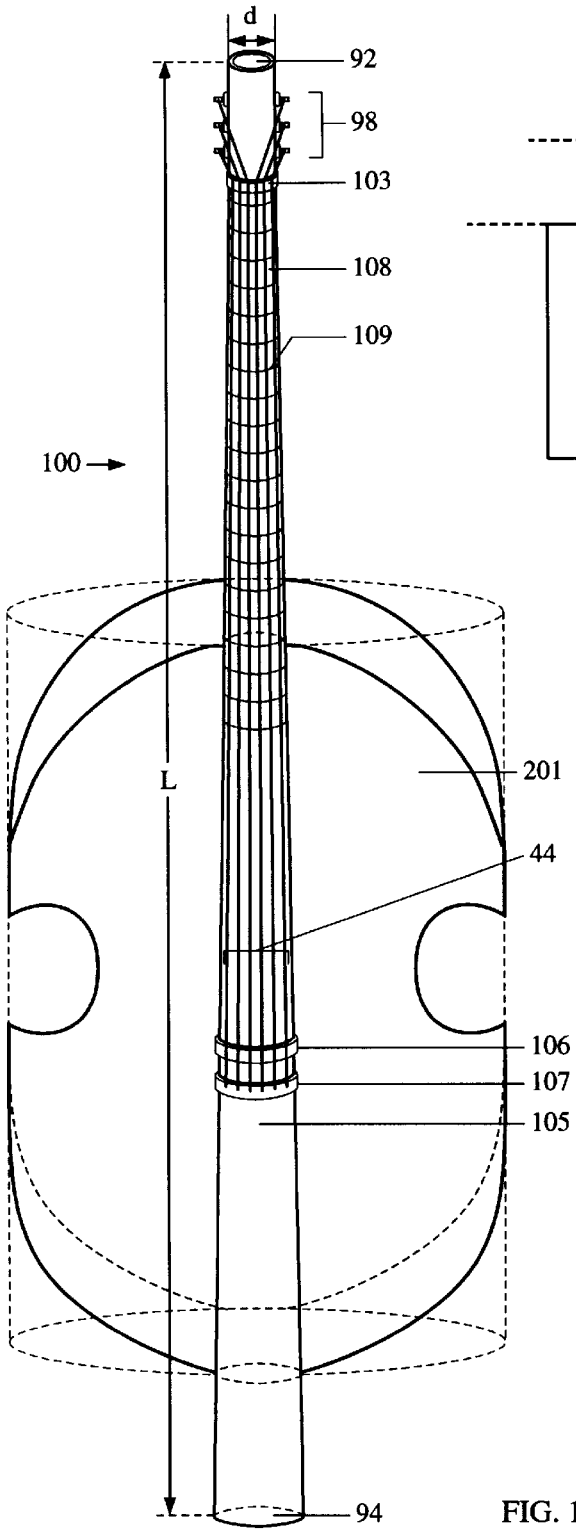
FIG. 17(*a*) is a front view of the hollow, conical stringed musical instrument 100 of the invention shown affixed to optional sound chamber 201.
Figure 17B:
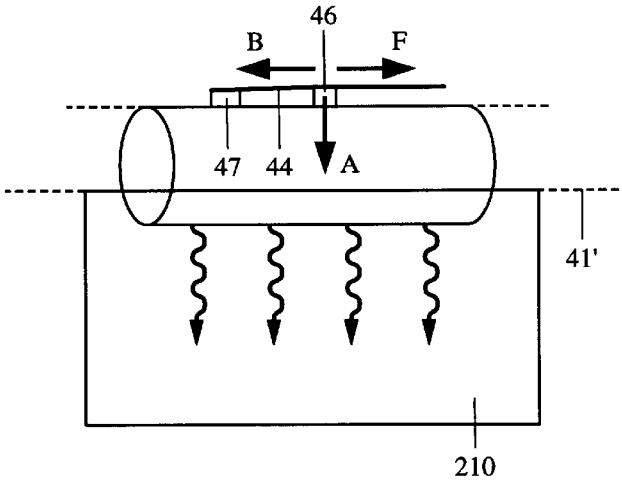

As shown in FIG. 17(*a*) there is illustrated, in broken line, the addition of an optional sound chamber or body structure 201 such that, when attached to the tubular stringed instrument 100, adds true acoustic performance without the acquisition of another instrument. Generally, the vibration of the top plate 41 (shown in FIG. 2) of a conventional string instrument via string vibration is transmitted through the bridge which sets the top plate into vibration. The instant neck/body 105 of the hollow, tubular instrument 100 in essence replaces and becomes the main transmitter of the strings' vibration. Thus, vibrations of the strings are transferred through the bridge 46 into the neck/body portion 105 of the tubular stringed instrument 100, which, in turn, transfers the vibration into the top plate 41' of the elliptical body 201 as shown in FIG. 17(*b*). Thus, the tubular instrument 100 acts as an acoustic preamp.

Specifically, the bridge 122 of the tubular stringed instrument 100 has a footprint of between ½" sq. in. and 6" sq. in. between the strings and the surface of the neck/body portion and an effective contact area up to 100 sq. in. between the tubular stringed instrument and a sound chambers' top plate. The increased footprint area attributable to the adaptation of the tubular, stringed instrument to a sound chamber, which essentially creates a dual-chambered musical instrument, leads to a vast improvement in the transferring of the kinetic energy of the string vibrations resulting in increased sonic and tonal quality of the musical instrument.

As further shown in FIG. 17(*a*), the sound chamber 201 can be made from any material demonstrating the resonance characteristic needed in an musical instrument. Indeed any and all prior art instruments can be retrofitted with the hollow, tubular instrument 100 of the invention. Preferably, the sound chamber 201 would include an elliptical cylinder with or without a taper whose length is proportionate to the scale length of the instrument as referred to by prior art standards such as described in Arthur H. Benade "Fundamentals of Musical Acoustics" Denver Pub. Oxford University Press 1990, the contents and disclosure of which is incorporated by reference herein. For instance, the chamber's width is proportionally ⅔ the scale of the its length and its thickness being ¼ the scale of its length. The sound chamber 201 can be made by the preferred method as defined in the process described in U.S. Pat. No. 5,576,082, but not limited to it, e.g., by using an elliptical cylindrical mandrel in which to roll the veneers. This body blank will then be cut to the desired shape with side portions being attached to the elliptical body and made with the common process of bonding veneers together over a form to create the desired side shapes.

With the body now whole the following process is the same for a retrofit, as it is for a new instrument. Particularly, the hollowed, tubular instrument neck sleeve is recessed into the instrument's top plate. The sleeve's inside profile is the same as the outside profile of the tubed instrument 100 so that when attached they will be practically seamless. To recess the sleeve, two cuts are made that run the length of the sound chamber. The profile of the sleeve is then cut out in the top and bottom "sides" of the sound chamber. It is at this point that the depth of the inset sleeve can be fixed. A depth proportionate to ¼ the diameter of the tubed instrument 100, for example, would provide a solid feel and exhibit good vibration transmission. The sleeve may then be laid into this cavity as such that the sleeve extends no more than ¼" above the top plate. A thin veneer strip may be glued to this adjoining seam for reinforcement. This sleeve will extend length wise an inch or two past the sound chamber ends, in proportion to the overall scale of the instrument, to allow for locking screws to secure the tubed instrument 100 to the sound chamber 201. This will allow the tubed instrument to be easily and conveniently connected and separated to/from the sound chamber 201. Further more the sleeve need not be of one piece and or may be slotted. A sound post and ribs may be attached to the sleeve and the bottom plate as with prior art.

In another embodiment, to form a unitary dual-chambered instrument comprising the tubed instrument 100 and sound chamber 200, the neck/body 120 may be inserted within the body portion of the sound chamber as discussed above and fixed underneath the top plate. Note that the portion of the neck/body fixed to the top plate is recessed to enable the fingerboard surface of the instrument 100 to seamlessly connect with the top plate of the sound chamber.

Regardless of whether the tubed stringed instrument is of unitary or modular design, and regardless of its length or cross-sectional shape, the instrument can be provided with other features such as, e.g., the ability to be amplified with attendant tone and volume controls, and/or the ability to be recorded.

Figure 9:
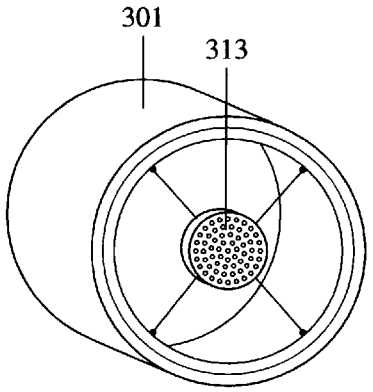
FIG. 9 illustrates the ring adaptor containing condenser microphone.
Figure 10:
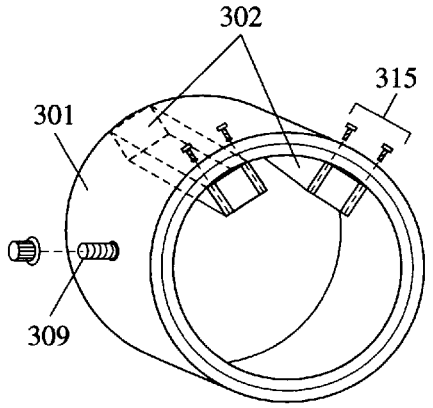
FIG. 10 illustrates the ring adaptor containing conventional magnetic pick-ups.

The amplification and the recording of tones produced by the hollow, tubular stringed instrument 100 of the invention is done through a suitable transducer medium. For instance, as shown in FIG. 10, a ring adaptor 301 is provided for mounting one or more transducer devices 310, e.g., magnetic pick-ups, the ring adaptor being provided with mounting structure designed to fit within the circular or elliptical cross-sectional profile of the neck/body portion for slidable movement inside the neck/body portion 105 of instrument 100. Particularly, the ring adaptor 301 contains mounting screws 315 for affixing the transducer to the ring adaptor 301. The adaptor 301 is designed such that it will enable any after-market brand name magnetic type pickups 302 to be installed inside the instrument and which pick-up may be attached by conventional lead to an amplifier (not shown). As shown in FIG. 9, the ring adapter 301 will additionally hold a condenser microphone 313.

Figure 8:
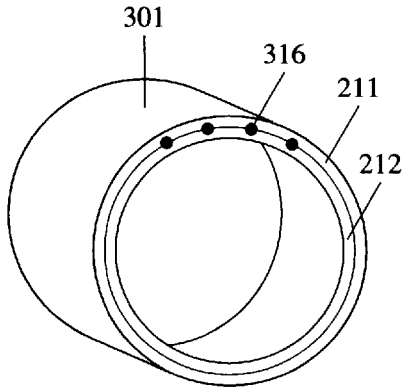
FIG. 8 illustrates the ring adaptor containing embedded transducer pickup structure.

Alternatively, as shown in FIG. 8, the ring adapter 301 can be designed to have a crystal transducer or ribbon transducer 316 imbedded in its structure. Preferably, the transducer device 316 could be imbedded in the walls of ether the neck/body portion, the sound chamber 201, the bridge 122, nut and/or ring adapter at the time these parts are made as according to the process outlined in U.S. Pat. No. 5,576,082. For instance, the process described in U.S. Pat. No. 5,576,082 can be modified whereby a ribbon transducer 316 is simply placed between a layer of veneers 211,212, the layer of veneers being arranged so that a cavity of a dimension commensurate with the thickness of the transducer is created. When the material is put under pressure and heated to bond the veneers with the glue, according to the teachings of U.S. Pat. No. 5,576,082, the transducer will be permanently kept under pressure. This will help reduce feed back while increasing its efficiently in converting instrument vibration into electronic analog or digital signals.

Regardless of the embodiments shown in FIGS. 8–10, the ring adapter 301 could be outfitted with a threaded bolt 309 that would protrude through a slot (not shown) provided in the wall of the tubular musical instrument, thus allowing the instrument user to adjust the position of the pickup, by loosing the screw then sliding the adaptor and, e.g., pick-up, to a position of the user's choice. As the basis of all musical instruments is a mixture of the means in which sound waves are created and the means in which sound wave proportions are modulated or changed, the location of the pickup has an profound effect on the sound of an instrument. By moving the ring adaptor/transducer assembly location on the instrument, the amount of 'fundamental frequency' is adjusted and, consequently, the amount of 'over tone' that is produced. By the same reasoning, as the proportions of the length of the tubular instrument 100' compared to its scale is changed, a different mixture of overtone and fundamental frequencies can be reinforced. Thus, proportionally for each given length of neck/body that is added or taken away, the deeper or thinner the tone can become.

Other modifications may be made such as, for example, providing a fan or air-modulating device (not shown) at one end of the instrument for modulating the sounds emanating from the ends of the instrument. Such a fan may operate at a fixed or variable speed and may be battery or externally powered. Likewise, an amplifier/speaker may be provided at the open end location of the instrument.

Figure 16:
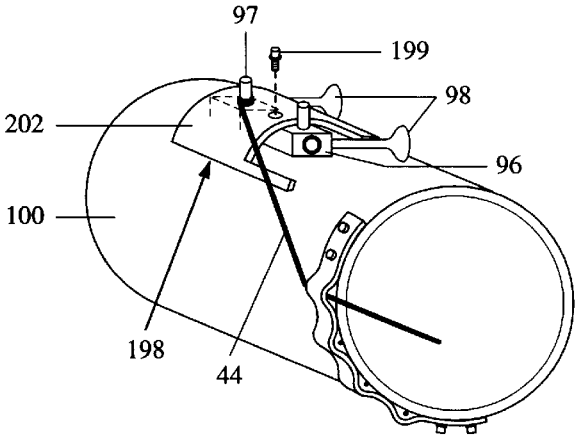
FIG. 16 illustrates a semicircular machine head cover bolted to the tubed instrument's headpiece.

To facilitate care of the tubed stringed instrument, and particularly, of the instrument's machine head gears 96, a machine head cover 198 is provided that is preferably a semicircular cover 202 that can be bolted to the tubed instrument's headpiece by bolt 199, as shown in FIG. 16. For instance, as shown in the cut-away view of the machine head cover in FIG. 16, the machine heads 98 are mounted to the instrument 100 with the machine head posts 97 pointing away from the instrument's body for ease in re-stringing. The machine head cover 198 protects the machine head gears 96.

The foregoing merely illustrates the principles of the present invention. Those skilled in the art will be able to devise various modifications, which although not explicitly described or shown herein, embody the principles of the invention and are thus within its spirit and scope.

What is claimed is:

1. A lightweight, musical instrument comprising:

a hollow, body portion forming a resonant sound chamber, said body portion being made of one or more layers of wood, said body portion having opposite ends and at least one wooden layer defining a fingerboard surface along a length of said body portion;

means located at each said opposite ends for tensioning a plurality of strings lengthwise along said fingerboard surface, said body portion being constricted and arranged to withstand the tensile forces created by said strings applied to said wooden layers at said opposite ends and defining structure for emanating sounds produced by vibrating said strings.

2. A lightweight, musical instrument as claimed in claim 1, wherein said strings are heavy gauge bass strings, said body portion being constructed and arranged to withstand the heavy gauge string tensions of up to 1200 psi applied perpendicular to the body surface.

3. A lightweight, musical instrument as claimed in claim 1, wherein said tensioning means includes tuning machines located at one opposite end of said body portion for tensioning said plurality of strings fastened at another opposite end of said body portion.

4. A lightweight, musical instrument as claimed in claim 1, wherein a thickness of said body portion ranges from about 1/16 to 1/4 inches.

5. A lightweight, musical instrument as claimed in claim 1, wherein said tensioning means further includes:

nut means mounted proximate said tuning means near one end of said body portion and positioned transverse to a length of said body portion for accommodating placement of strings there across;

bridge means located at another end of said body portion and positioned transverse thereto for adjustably raising each of said strings a distance above said fingerboard surface.

6. A lightweight, musical instrument as claimed in claim 1, wherein one of said first and second opposite ends is closed.

7. A lightweight, musical instrument as claimed in claim 1, wherein said first and second opposite ends are closed.

8. A lightweight, musical instrument as claimed in claim 5, wherein a cross-sectional profile of said hollow, body portion is a conic section.

9. A lightweight, musical instrument as claimed in claim 5, wherein a cross-sectional profile of said hollow, body portion is a compound conic section.

10. A lightweight, musical instrument as claimed in claim 5, further including means for reinforcing tension of said fingerboard surface.

11. A lightweight, musical instrument as claimed in claim 10, wherein said reinforcing means includes an adjustable truss rod, said truss rod being of I-beam construction.

12. A lightweight, musical instrument as claimed in claim 5, further including a transducer means for converting audio signals resonating in said body to electrical signals, said transducer means capable of being located anywhere on said body portion to emphasize desirable audio signals.

13. A lightweight, musical instrument as claimed in claim 12, wherein said transducer means is embedded in said body portion between said one or more layers of wood.

14. A lightweight, musical instrument as claimed in claim 1, wherein said hollow body portion is tapered in a lengthwise direction, said body having a first end of greater diameter than a second end.

15. A lightweight, musical instrument as claimed in claim 1, wherein said hollow body portion is of constant diameter.

16. A lightweight, musical instrument as claimed in claim 3, wherein said tuning machines are mounted to an exterior portion of said hollow, body portion.

17. A lightweight, musical instrument as claimed in claim 1, further including sound chamber means for providing resonance of tones generated by said plurality of strings, said body portion of said instrument providing a first resonant chamber for said tones, and said sound chamber means providing a second resonant chamber for said tones.

18. A modular, lightweight musical instrument comprising:

a hollow, tubular head section for mounting a plurality of string tensioning devices capable of receiving a plurality of strings;

a hollow, tubular body portion having a first end capable of receiving a portion of said head section for aligned engagement therewith, said hollow, tubular body portion made of one or more layers of wood and having at least one wooden layer defining a fingerboard surface along a length of said body portion;

a hollow, tubular tail section for aligned engagement with a second end of said hollow, body portion and including means cooperating with said plurality of string tensioning devices for tensioning said plurality strings along said fingerboard surface, said body portion defining structure for emanating sounds produced by vibrating said plurality of strings tensioned there across.

19. A modular, lightweight musical instrument as claimed in claim 18, further comprising a nut means for engagement between said head section and hollow body sections and positioned transverse to a length of said body portion for aligning strings tensioned along the length of said body surface.

20. A modular, lightweight musical instrument as claimed in claim 18, further comprising bridge means for engagement between said tail section and hollow body sections and positioned transverse to a length of said body portion for adjustably raising each of said plurality of strings a distance above said body surface.

21. A modular, lightweight musical instrument as claimed in claim 18, wherein said head section includes a portion in friction engagement with said hollow body section.

22. A modular, lightweight musical instrument as claimed in claim 18, wherein said tail section includes a portion in friction engagement with said hollow body section.

23. A modular, lightweight musical instrument as claimed in claim 18, wherein each said hollow tubular head, tail and body sections are tapered in a lengthwise direction, said instrument being tapered with a first end being of greater circumference than a second end.

24. A modular, lightweight musical instrument as claimed in claim 18, wherein each said hollow tubular head, tail and body sections are of even diameter.

25. A modular, lightweight musical instrument as claimed in claim 18, wherein a cross-sectional profile of each said hollow tubular head, body and tail portions is a conic section.

26. A modular, lightweight musical instrument as claimed in claim 18, wherein a cross-sectional profile of each said hollow tubular head, body and tail portions is a compound conic section.

27. A lightweight, musical instrument as claimed in claim 18, further including a transducer means for converting audio signals resonating in said body to electrical signals, said transducer means capable of being located anywhere on said body portion to emphasize desirable audio signals.

28. A modular, lightweight, musical instrument as claimed in claim 27, wherein said transducer means is embedded in said body portion between said one or more layers of wood.

29. A modular, lightweight musical instrument as claimed in claim 18, wherein a thickness of each said hollow tubular head, body and tail portions ranges from about 1/16 to 1/4 inches.

30. A modular, lightweight musical instrument as claimed in claim 18, further including a base extension releasably mountable to said hollow tubular tail section for extending a length of said instrument.

31. A modular, lightweight musical instrument as claimed in claim 18, wherein said fingerboard surface of said body portion includes a plurality of frets, said instrument further comprising a second fingerboard surface that is fretless, said hollow, tubular body portion capable of being rotated to present either said fretted or fretless fingerboard surface to a player of said instrument.

32. A modular, lightweight, musical instrument as claimed in claim 18, having a first end of said head portion and a second opposite end at said tail portion, wherein one of said first and second opposite ends is closed.

33. A modular, lightweight, musical instrument as claimed in claim 18, having a first closed end of said head section and a second closed end at said tail portion.

34. A modular, lightweight, musical instrument as claimed in claim 18, wherein said tensioning means includes tuning machines mounted to an exterior portion of said hollow, head portion.

35. A modular, lightweight musical instrument as claimed in claim 18, further including sound chamber means for providing resonance of tones generated by said plurality of strings, said body section of said instrument providing a first resonant chamber for said tones, and said sound chamber means providing a second resonant chamber for said tones.

36. A modular, lightweight musical instrument as claimed in claim 18, wherein a thickness of each said hollow, tubular head, body and tail sections ranges from about 1/16 to 1/4 inches.

37. A modular, lightweight musical instrument comprising:

a hollow, tubular head section for mounting a plurality of string tensioning devices capable of receiving a plurality of strings;

a hollow, tubular body portion having a first end capable of receiving a portion of said head section for aligned engagement therewith, said hollow, tubular body portion made of one or more layers of wood and having at least one wooden layer defining a fingerboard surface along a length of said body portion;

a hollow, tubular tail section for aligned engagement with a second end of said hollow, body portion and including means cooperating with said plurality of string tensioning devices for tensioning said plurality strings along said fingerboard surface, said body portion defining structure for emanating sounds produced by vibrating said plurality of strings tensioned there across; and, chamber means for attachment to said body portion for providing resonance of tones generated by said plurality of strings, said body portion of said instrument providing a first resonant chamber for said tones, and said sound chamber means providing a second resonant chamber for said tones.

* * * * *